US005987724A

United States Patent [19]

Kleman

[11] Patent Number: 5,987,724

[45] Date of Patent: Nov. 23, 1999

[54] CROSSBOW BOLT CAP AND FLETCHING NOCK DEVICE AND METHOD

[76] Inventor: John Kleman, 7302 E. Baseline Rd., Mesa, Ariz. 85208

[21] Appl. No.: 08/813,895

[22] Filed: Mar. 7, 1997

[51] Int. Cl.[6] ..... B21K 21/16

[52] U.S. Cl. ..... 29/401.1; 269/38; 473/578

[58] Field of Search ..... 29/2.1, 401.1; 269/38; 473/578

[56] References Cited

U.S. PATENT DOCUMENTS

| | | | |
|---|---|---|---|
| 1,794,051 | 2/1931 | Allen | 269/38 X |
| 3,108,792 | 10/1963 | Martin | 269/38 |
| 3,322,421 | 5/1967 | Sisty | 269/38 |
| 4,621,817 | 11/1986 | Musacchia | 473/578 X |
| 5,061,008 | 10/1991 | Saunders | 269/38 |
| 5,067,731 | 11/1991 | Bickel | 473/578 |
| 5,306,020 | 4/1994 | Bolf | 473/578 |
| 5,516,117 | 5/1996 | Rangel | 473/578 |
| 5,803,843 | 9/1998 | Anderson et al. | 473/578 |

*Primary Examiner*—David P. Bryant
*Attorney, Agent, or Firm*—Douglas S. Bishop

[57] ABSTRACT

A device and method for adapting an arrow bolt fletching tool for use in fletching crossbow arrow bolts. The invention is designed to facilitate fletching crossbow arrow bolts, which are shot without nocks, utilizing a commercially available fletching tool which is designed and produced for use in fletching arrows having nocks which remain with the arrow and are shot with it. The invention provides for an end cap, containing a specially shaped indentation, to be placed in the end of the crossbow arrow bolt. A special fletching nock, with an end configured to fit within the indentation of the end cap, is inserted within the end cap for purposes of fletching the arrow only and is then removed. The fletching nock has a forked, or u-shaped, end, which engages the fletching tool in the same manner as a standard arrow nock.

8 Claims, 4 Drawing Sheets

10
17
19

13
13
16
18
11
10
17
12
23
11
10
17
12
19
20

15
14
22
24
26
25
21

CROSSBOW BOLT CAP AND FLETCHING NOCK DEVICE AND METHOD

FIELD OF THE INVENTION

This invention relates to the field of archery and the fletching of arrows utilizing a fletching tool and, more particularly, adapting a fletching tool for purposes of fletching crossbow bolts which are shot without an arrow nock.

BACKGROUND OF THE INVENTION

The field of archery includes traditional archery, and crossbow archery. Many archery enthusiasts, both traditional and crossbow, manufacture or assemble their own arrows from components. The arrow shafts, on to which vanes or feathers are attached, are called bolts. Typically, arrows are manufactured with three or four plastic vanes or feathers which are generally fletched or attached to the bolt at 90° separations for four vanes and 120° for three vanes. To assist in the process of attaching the vanes or feathers to the arrow bolt, called "fletching," specifically designed fletching tools or "jigs" are commercially available for the enthusiast. The Bohning Professional Arrow Fletching Jig, sold by The Bohning Company, Ltd., Lake City, Mich., is an example of a commercially available fletching tool in which an arrow is inserted. The fletching tool has a rotating indexer component in which the nock end of a traditional arrow is inserted and which is engaged by the opening in the nock end. The rotating indexer is set to rotate in increments of either 90° or 120°, thus putting the arrow bolt in position for fletching, or attachment of a vane or feather, at each specific interval.

Traditional archery arrows, and some crossbow arrows, are manufactured with a nock attached to the arrow bolt. The purpose of the nock is to engage the bow string or draw string and to maintain contact of the arrow with the draw string or bow string, which is the propelling force, when the arrow is shot. The existing art provides numerous examples of nocks and special adaptations of nocks for this purpose, including various methods of affixing the nock to the arrow bolt. For example, U.S. Pat. No. 5,306,020, to Bolf, describes an arrow which is arranged to threadedly receive a nock member. U.S. Pat. No. 5,361,747, to Laabs, describes a nock with a corresponding element which is attached directly to the bow string. U.S. Pat. No. 5,290,044, to Easton et al, describes an arrow nock containing a stiffener of light weight high strength material. U.S. Pat. No. 5,154,432, to Saunders, describes an arrow nock orientation assembly allowing the user to select a preferred orientation between a reference vane on an arrow or on an arrow bolt shaft and the bow string receiving slot of the arrow nock. U.S. Pat. No. 4,644,163, to Scanlon, describes an arrow nock with a cylindrical body member having a plug shaft extending axially, to one side, for insertion within an arrow shaft.

With particular regard to the attachment of a nock, by use of an adapter, to an arrow shaft, reference is made to U.S. Pat. No. 5,067,731, and U.S. Pat. No. 5,417,439, both to Bickel, specifically relating to the manner in which an arrow nock is mounted on an arrow shaft.

With regard, however, to crossbow bolts, no nock is utilized. A bolt cap having a planar surface perpendicular to the axis of the arrow, and of approximately the same dimension of the arrow, is placed in the end of the arrow shaft. Accordingly, there being no nock, there is nothing to engage the rotating indexer of a fletching tool or jig for fletching purposes.

While it is known, as indicated in the patents to Bickel, to insert an adapter within an arrow shaft, to receive a nock assembly, none of the prior art presented demonstrates such an adapter which, without the nock in place, presents a sufficient planar surface for engaging a bow string in the manner required of a crossbow bolt. Such prior art, further, though providing for potential replacement of a nock, does not provide a readily insertable and removeable nock, which would allow for a reasonable method of fletching a crossbow bolt. The prior art, further, does not provide, in any respect, for a method of adapting a fletching tool for use with nockless arrows. Accordingly, archery enthusiasts using standard crossbow bolts, do not have readily available devices, or methods, to fletch the same with the degree of certainty provided by a commercially available fletching tool or jig as is currently used in conjunction with a traditional, nocked arrow.

Accordingly, a need exists, and it would be desirable to provide a device for and a method of adapting a commercially available fletching tool for use in fletching crossbow bolts which, upon completion of the process provided by the disclosed method, such crossbow bolt is still in a condition to be shot by a crossbow.

It would further be desirable to provide such a device and method wherein the arrow bolt is held sufficiently in place for circular movement of the bolt about its longitudinal axis but, wherein, the means for engaging the bolt with the fletching tool, for fletching purposes, is not otherwise permanently, or semi-permanently, affixed.

SUMMARY OF THE INVENTION

The present invention has been designed to overcome the shortcomings in the prior art as noted above. It is a device and method for adapting an arrow fletching tool for use with crossbow bolts which do not include a nock element.

The device includes a novel arrow bolt end cap member designed to be either permanently, or removeably, affixed within a hollow cylindrical arrow shaft, or bolt, which end cap has a flat, planar surface, perpendicular to the general longitudinal axis of the arrow shaft and which perpendicular planar surface further includes an indentation, or aperture, in polygonal shape, centrally located on such surface, and an engagement member, or fletching nock member, in a polygonal-shaped protrusion, correspondingly sized to fit within the indentation or aperture in the end cap is provided and has, at its opposing end, a pair of parallel arms extending outward, defining a slot, which engages the rotating indexer of the fletching tool in the same manner as a traditional arrow nock.

In one preferred embodiment of the invention, the end cap is affixed within the arrow shaft, the fletching nock member is inserted into the arrow end cap and the assembly, using the protruding parallel members, then engages the stated portion of the fletching tool so as to provide, through the fletching tool, rotation of the arrow shaft around its longitudinal axis.

In another preferred embodiment of the invention, the fletching nock member may be directly engaged with the rotating indexer of the fletching tool and the arrow bolts, with the end cap element installed, placed on the fletching nock member for fletching purposes, and then removed therefrom.

In another preferred embodiment, the polygonal-shaped end of the fletching nock is in the shape of a truncated pyramid, the outer circumference of which is smaller than the circumference of the indentation in the end cap member and the inboard circumference of which is greater than the circumference of said indentation, to facilitate engagement and disengagement between the arrow, with end cap, and the fletching nock member.

In another preferred embodiment, as a final step in the method provided, the end cap having the indentation may be removed and replaced by an end cap without an indentation.

In a further preferred embodiment of the invention, the end cap may be permanently affixed within the arrow bolt by adhesive means.

In a further preferred embodiment of the invention, the fletching nock member may be permanently engaged with the fletching tool rotating indexer by use of an adhesive or other means.

BRIEF DESCRIPTION OF THE DRAWINGS

The following detailed description is best understood by reference to the following drawings, in which.

DETAILED DESCRIPTION OF THE PREFERRED EMBODIMENT

Throughout the following detailed description, like numerals are used to reference the same element of the present invention, although the same may be shown in more than one figure thereof.

Figure 6:
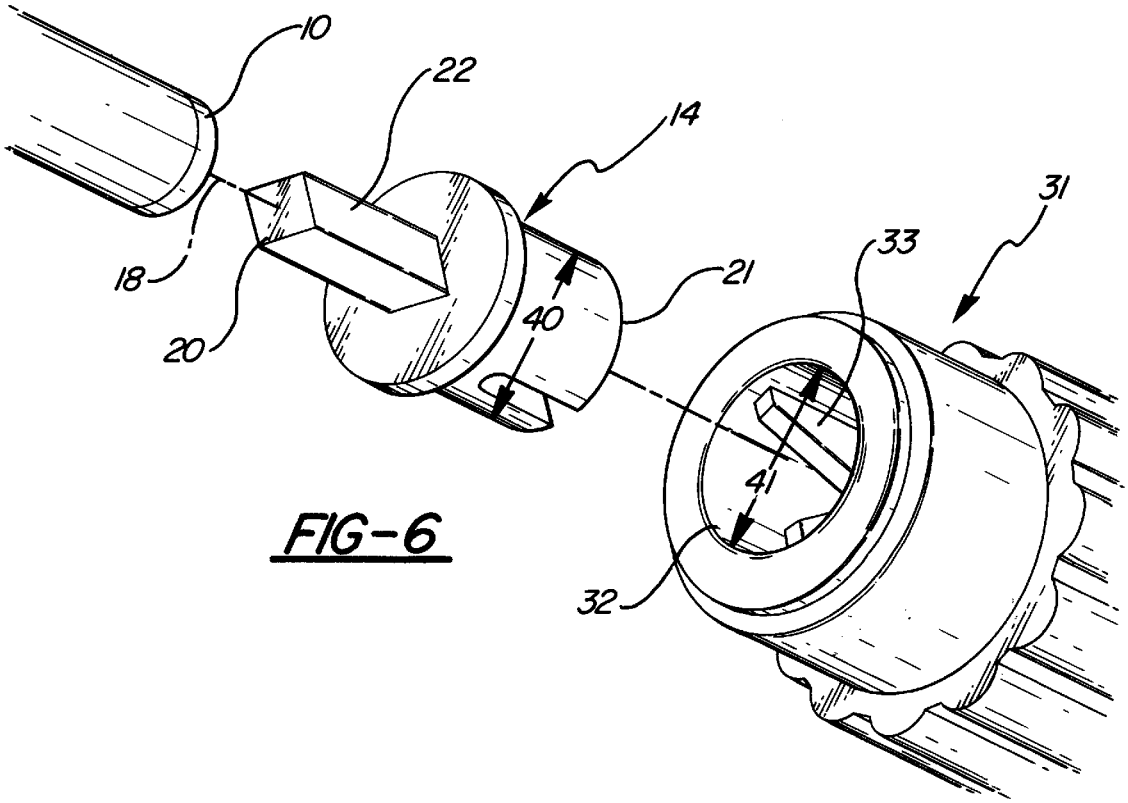
FIG. 6 is a perspective view of the rotating indexer of a fletching tool, a fletching nock member, and a crossbow bolt with end cap installed in position for fletching use in accordance with the disclosed method.

The invention Crossbow Bolt Cap & Fletching Nock Device, broadly considered, includes a cylindrical bolt cap member 10, which has a bolt end 11 which is disposed toward the hollow cylindrical arrow bolt 13 and additionally has a fletching nock end 12 which is disposed toward the fletching nock member 14 all as shown in the relationship set forth in FIG. 6. The bolt end 11 is of a diameter which will permit insertion of the bolt end 11 within the arrow bolt 13 in a male-female relationship. The fletching nock end 12 of the bolt cap member 10 has a diameter equal to the exterior diameter 16 of the arrow bolt 13. The fletching nock end 12 of the bolt cap member 10 further has a planar surface 17, which surface 17 is perpendicular to the longitudinal axis 18 of the arrow bolt 13. Within the planar surface 17, is an indentation or opening 19 which is in the shape of a polygon. The opening or indentation 19 is centrally aligned with the longitudinal axis 18.

The invention further includes a fletching nock member 14. Fletching nock member 14 has an end 20 disposed toward the bolt cap member 10 and an end 21 disposed toward the fletching tool 30, again as shown in the relationship depicted in FIG. 6. End 20 of fletching nock member 14 is a protrusion 22 in the shape of a polygon corresponding to the shape of the indentation or opening 19 and configured to be inserted in and withdrawn from opening 19 in a male-female relationship. End 21 of fletching nock member 14 has a diameter equal to or larger than the exterior diameter 23 of arrow bolt 13. End 21 further includes two corresponding members 24 and 25 extending parallel to longitudinal axis 18. The distance between members 24 and 25 defines a slot 26 which engages the fletching tool 30 in the same manner as an arrow nock.

The fletching tool 30 includes a rotating indexer 31, having a concave portion 32 which includes a diametric cross member 33 within it, upon which a standard arrow nock and/or the fletching nock member 14 of the present invention may be engaged.

Figure 1:
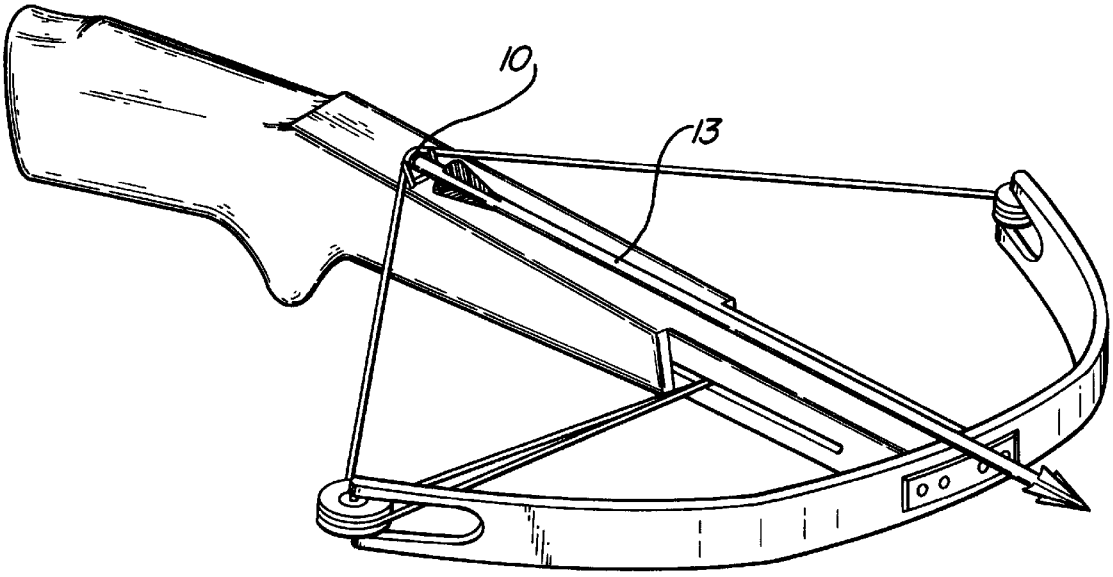
FIG. 1 is a perspective view of a crossbow device showing a nockless crossbow bolt in shooting position.
Figure 2:
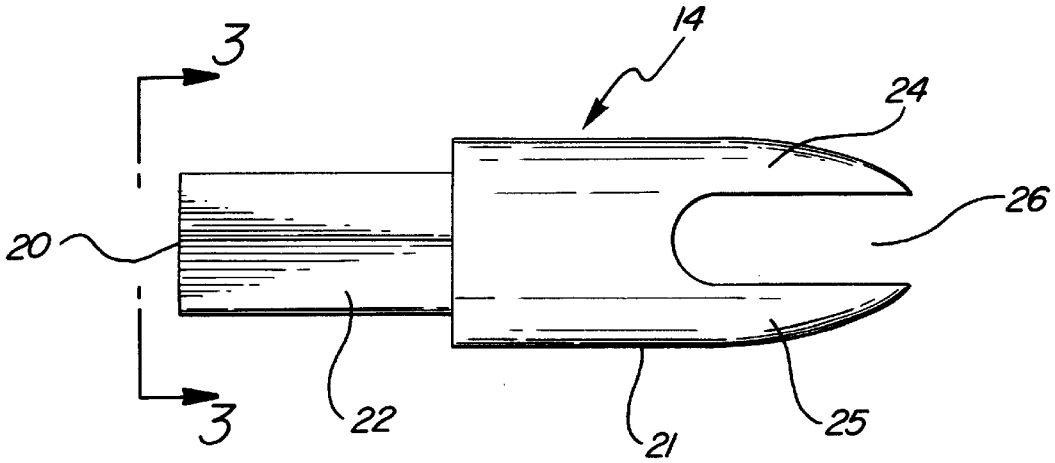
FIG. 2 is a side view of a fletching nock member showing the slot defined by the member for engaging the fletching tool and demonstrating the alignment of such member to the bolt end cap member.
Figures 3, 4, 7:
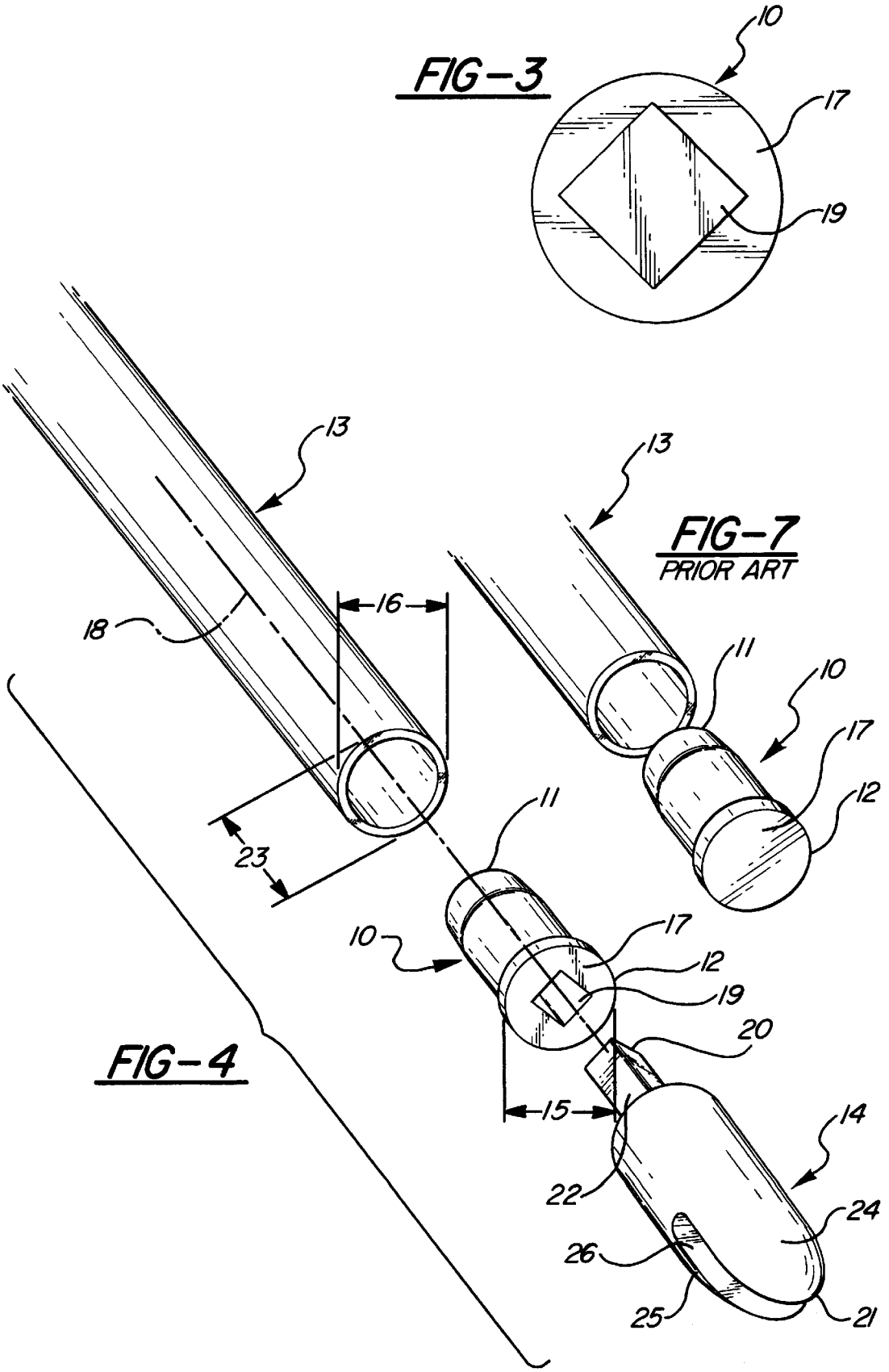
FIG-7 PRIOR ART
FIG. 3 is a top view of the end cap member, showing the polygonal aperture defined thereby.
FIG. 4 is a perspective view of the components of the device, including a cylindrical crossbow bolt, and end cap member, and fletching nock member in relative position for assembly.
FIG. 7 is a perspective view of a crossbow bolt and crossbow end cap as shown by the prior art.
Figure 5:
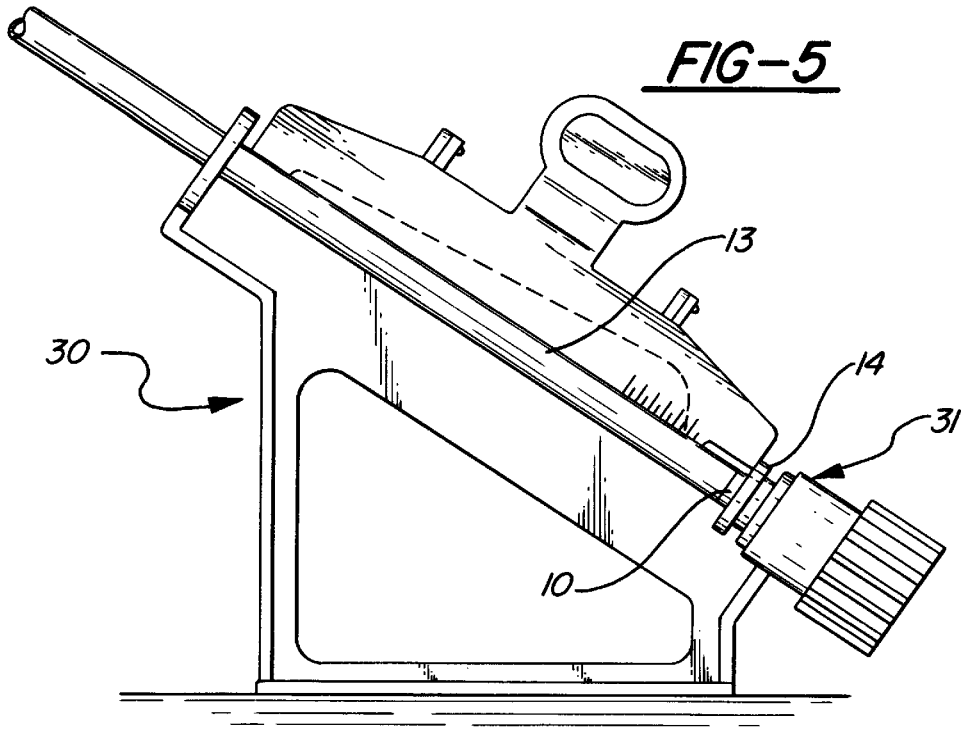
FIG. 5 is a side-view of a fletching tool having a rotating indexer, with an arrow shaft in place, for fletching purposes.

In the present invention, the bolt cap member 10 is inserted within arrow bolt 13. The bolt end 20 of the fletching nock 14 is inserted within the opening 19 of bolt cap member 10. End 21 of fletching nock 14 is then engaged with the rotating indexer 31 of fletching tool 30 in the relationship shown in extension in FIG. 6 and in a perspective view, in an assembled relationship, as shown in FIG. 5. The rotating indexer 31 of fletching tool 30 is then rotated, which, in turn, rotates arrow bolt 13 about its longitudinal axis 18 as desired for fletching purposes. Upon completion of the fletching operations, arrow bolt 13 containing end cap 10 is separated from fletching nock 14 and fletching nock 14 is disengaged from the fletching tool 30, leaving arrow bolt 13 in form to be shot from a crossbow, in the manner as shown in FIG. 1 and fletching tool 30 in form to accept a standard archery arrow or, in the method of the present invention, to accept another crossbow bolt 13.

In the embodiment shown in FIG. 6, end 21 of the fletching nock member 14 has an exterior diameter 40 configured to approximate the interior diameter 41 of the concave portion 32 of rotating indexer 31 in a manner which allows fletching nock member 14 to rest within concave portion 32 in a male-female relationship.

An adhesive means may also be used to permanently engage fletching nock member 14 with the fletching tool 30 in the manner of engagement previously set forth. If desired, adhesive means may also be utilized to permanently secure bolt cap member 10 within arrow bolt 13.

As shown in the embodiment of FIG. 6, bolt cap member 10 may be inserted within arrow bolt 13. Fletching member 14 may then be engaged with fletching tool 30 and arrow bolt 13, through bolt cap 10, may then be attached and disattached to the fletching tool 30 through fletching nock member 14.

Figure 8:
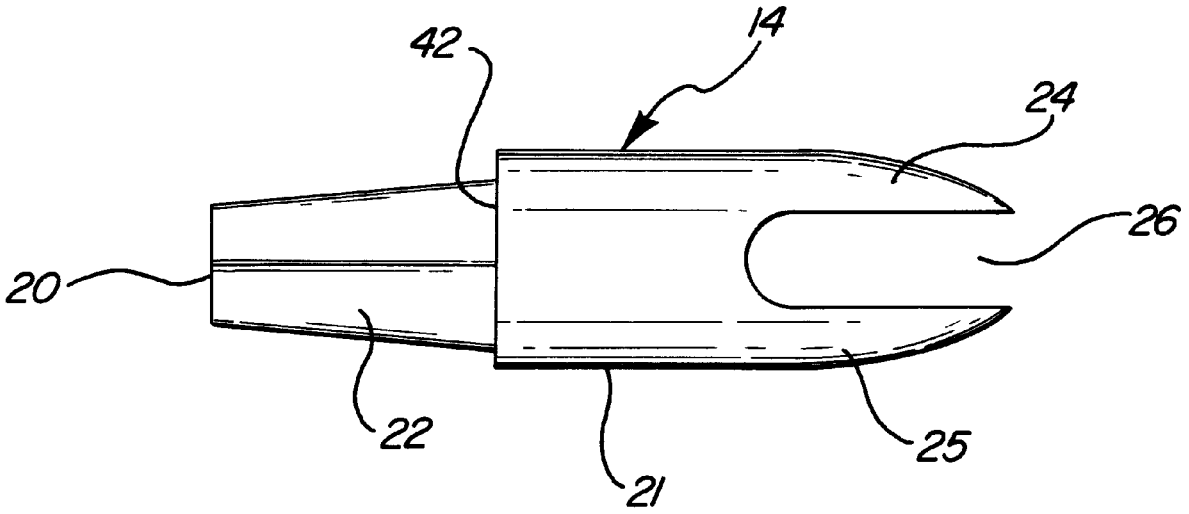
FIG. 8 is a side view of a fletching nock member showing the slot defined by the member for engaging the fletching tool and demonstrating the alignment of such member to the bolt end cap member, where the bolt end cap member is a truncated pyramid.

The ready association and disassociation of fletching nock member 14 and bolt cap member 10, through insertion of protrusion 22 in opening 19, for fletching purposes only, may further be facilitated by provision of a protrusion 22 in the shape of a truncated pyramid as shown in FIG. 8, the bolt end 20 of which corresponds with the shape of opening 19, but is of a lesser exterior dimension than opening 19 and the fletching tool end 42 of which corresponds with the shape of opening 19, but is of a greater exterior dimension than opening 19.

Although a preferred embodiment of the invention has been illustrated and described in detail, it will be apparent that various changes may be made in the disclosed embodiment without departing from the spirit of the invention.

What is claimed is:

1. A method of adapting an arrow bolt fletching tool having a rotating arrow bolt indexer for use in fletching a hollow cylindrical crossbow arrow bolt having an interior diameter and exterior diameter, said method including the steps of:

A. providing a bolt cap member comprising:

a bolt end having an exterior diameter sufficient to permit insertion of said bolt end into said arrow bolt in a male-female relationship; and a fletching nock end having a diameter equal to the exterior diameter of said arrow bolt, said fletching nock end having a planar surface perpendicular to the longitudinal axis of said arrow bolt, and a polygonal aperture defined in said planar face and centrally aligned with the longitudinal axis of the arrow bolt;

B. providing a fletching nock member having a bolt cap end with a polygonal, male member defined thereupon, said male member being configured to be removeably insertable into said polygonal aperture; said fletching nock member further including a fletching tool end having a diameter at least as great as the exterior diameter of the arrow bolt and further including a pair of members extending parallel to the longitudinal axis of the arrow bolt so as to define a slot;

C. inserting the male member of the fetching nock member into the polygonal aperture of the bolt cap;

D. engaging the rotating bolt indexer of the fletching tool with the slot defined by the pair of members of the fletching nock member; and E. removing the fletching nock member from the bolt cap member upon completion of fletching.

2. A method, as in claim 1, wherein the step of inserting the male member of the fletching nock member into the polygonal aperture is implemented before the step of engaging the rotating bolt indexer with the slot.

3. A method, as in claim 1, wherein the step of inserting the male member of the fletching nock member into the polygonal aperture is implemented after the step of engaging the rotating bolt indexer with the slot.

4. The method of adapting an arrow bolt fletching tool having a rotating arrow bolt indexer for use in fletching a hollow cylindrical crossbow arrow bolt having an exterior diameter and interior diameter of claim 1, wherein, said method includes the additional step of removing the cylindrical bolt cap member having a planar surface defining a polygonal aperture, after fletching, and replacing said cylindrical bolt cap member with a cylindrical bolt cap member, having an unbroken planar surface.

5. The method of adapting an arrow bolt fletching tool having a rotating bolt indexer for use in fletching a hollow cylindrical crossbow arrow bolt having an interior diameter and exterior diameter, of claim 4, wherein the engagement of the fletching nock member with the rotating arrow bolt indexer is made permanent by adhesive means.

6. A method of adapting an arrow bolt fletching tool having a rotating arrow bolt indexer for use in fletching a hollow cylindrical crossbow arrow bolt having an interior diameter and exterior diameter, said method including the steps of:

inserting a cylindrical bolt cap member into the cylindrical crossbow arrow bolt, said bolt cap member comprising:

a bolt end having an exterior diameter sufficient to permit insertion of said bolt end of said member within said arrow bolt in a male-female relationship and a fletching nock end having a diameter equal to the exterior diameter of said arrow bolt;

said fletching nock end having a planar surface perpendicular to the longitudinal axis of said arrow bolt;

said planar surface further defining a polygonal aperture centrally aligned with the longitudinal axis of said arrow bolt;

engaging the rotating the bolt indexer of the fletching tool utilizing a fletching nock member having a bolt cap end comprising a polygonal male member correspondingly configured to be removeably insertable within said polygonal aperture defined by the planar surface of the bolt cap and having a fletching tool end of a diameter at least as great as the exterior diameter of said arrow bolt and further comprising a pair of members extending parallel to the longitudinal axis of the arrow bolt, defining a slot, as the means for so engaging the rotating bolt indexer;

mounting the cylindrical crossbow arrow bolt onto the arrow bolt fletching tool by removeably inserting the corresponding polygonal male member comprising the bolt cap end of the fletching nock member into the corresponding polygonal aperture defined by the planar surface of the cap member inserted within the cylindrical crossbow arrow bolt, so as to provide for rotation of said arrow nock about its longitudinal axis when said bolt indexer is rotated, for fletching purposes; and removing said arrow bolt having an inserted cylindrical bolt cap member from the bolt end of the fletching nock member upon completion of fletching.

7. The method of adapting an arrow bolt fletching tool having a rotating bolt indexer for use in fletching a hollow cylindrical crossbow arrow bolt having an interior diameter and exterior diameter, of claim 5, wherein a portion of the fletching tool end of the fletching nock member has an exterior diameter corresponding with a interior dimension of a concave nock receptacle portion of the rotating arrow bolt indexer so that said fletching nock member corresponds with said rotating arrow bolt indexer in a male-female relationship.

8. The method of adapting an arrow bolt fletching tool having a rotating bolt indexer for use in fletching a hollow cylindrical crossbow arrow bolt having an interior diameter and exterior diameter, of claim 5, wherein said method further includes the additional step of affixing the cylindrical bolt cap member within the cylindrical crossbow arrow bolt, by adhesive means.

* * * * *